US009259609B2

(12) United States Patent
Yang

(10) Patent No.: US 9,259,609 B2
(45) Date of Patent: Feb. 16, 2016

(54) EXERCISE BIKE

(71) Applicant: VENTEK FITNESS CORPORATION, Yunlin County (TW)

(72) Inventor: Wen Chang Yang, Taichung (TW)

(73) Assignee: Ventek Fitness Corporation, Yunlin County (TW)

( * ) Notice: Subject to any disclaimer, the term of this patent is extended or adjusted under 35 U.S.C. 154(b) by 0 days.

(21) Appl. No.: 14/621,783

(22) Filed: Feb. 13, 2015

(65) Prior Publication Data

US 2015/0238805 A1 Aug. 27, 2015

(30) Foreign Application Priority Data

Feb. 21, 2014 (TW) ..... 103203007 U

(51) Int. Cl.

| | |
|---|---|
| ***A63B 21/00*** | (2006.01) |
| ***A63B 22/00*** | (2006.01) |
| ***A63B 22/06*** | (2006.01) |
| ***A63B 21/015*** | (2006.01) |
| ***A63B 23/04*** | (2006.01) |

(52) U.S. Cl.

CPC ..... *A63B 22/0015* (2013.01); *A63B 21/015* (2013.01); *A63B 21/4033* (2015.10); *A63B 21/4049* (2015.10); *A63B 22/0605* (2013.01); *A63B 23/0405* (2013.01); *A63B 23/0476* (2013.01)

(58) Field of Classification Search

USPC ..... 482/1–148

See application file for complete search history.

(56) References Cited

U.S. PATENT DOCUMENTS

| | | | | |
|---|---|---|---|---|
| 4,309,043 | A * | 1/1982 | Brown | B62M 3/06 280/236 |
| 6,468,178 | B1 * | 10/2002 | Mohtasham | B62M 11/16 280/238 |
| 6,830,538 | B2 * | 12/2004 | Eschenbach | A63B 21/00178 482/52 |
| 7,520,196 | B2 * | 4/2009 | Stallard | B62M 3/04 74/594.1 |
| 2005/0263978 | A1 * | 12/2005 | Ascher | B62K 15/006 280/261 |

* cited by examiner

*Primary Examiner* — Stephen Crow

(74) *Attorney, Agent, or Firm* — Rosenberg, Klein & Lee

(57) ABSTRACT

An exercise bike includes a frame, a driving member, two sun gears, two swing arms, two planet gears, and two cranks. The driving member is assembled to the frame and has a shaft extending from two sides of the frame. The two sun gears, the two swing arms, the two planet gears, and the two cranks are respectively assembled to the two sides of the frame. For each set, the crank drives the planet gear to rotate so as to drive the swing arm to rotate the shaft, and the planet gear is rotated around the sun gear. Accordingly, a pedal connected to each of the cranks moves around the axis of the corresponding planet gear.

5 Claims, 8 Drawing Sheets

EXERCISE BIKE

BACKGROUND OF THE INVENTION

1. Field of the Invention

The present invention relates to an exercise bike, and more particularly to an exercise equipment capable of performing cycling.

2. Description of the Prior Art

As shown in FIG. 8, a frame 94 of a conventional exercise bike mainly includes a base 91, a seat 92, and a handlebar 93. The frame 94 is connected to a rotating shaft 96 via a rotating plate 95. The rotating shaft 96 is connected to two cranks 97. An end portion of each of the cranks 97 is assembled to a pedal 971. The rotating plate 95 drives a passive wheel 98 to rotate. For operation, a user sits on the seat 92 with his/her hands holding the handlebar 93 and his/her two legs treading on the pedals 971 to drive the rotating shaft 96 via the cranks 97 so as to rotate the rotating plate 95. Since the passive wheel 98 has a certain weight, when the user rotates the passive wheel 98 under loading of the passive wheel 98 by treading on the pedals 971, the user do exercise to strength his/her body by the conventional exercise bike.

However, the rotation of the rotating plate 95 uses the rotating shaft 96 as the rotating center. That is, when the two legs of the user are treading on the pedals 971, the pedals 971 are simply cycling around the rotating shaft 95. As a result, the movement of the pedals 971 is monotone, and the number of muscles used to perform the exercise is insufficient to meet user requirements.

The present invention is, therefore, arisen to obviate or at least mitigate the above mentioned disadvantages.

SUMMARY OF THE INVENTION

One object of the present invention is to address the aforementioned problems and to provide an exercise bike to change the movement of the pedals during exercise, and to allow more muscle groups being used during the exercise.

To achieve the above and other objects, an exercise bike is provided. The exercise bike comprises a frame, a driving member, two sun gears, two swing arms, two planet gears, and two cranks. The frame is assembled to a base. A seat and a handlebar are assembled on the base, and the handlebar is in front of the seat. The driving member is assembled to the frame and has a shaft being rotatable. The shaft is extending from two sides of the frame. The two sun gears are respectively coaxially fitted over the shaft to be fixed at two sides of the driving member, and two ends of the shaft respectively passing through the two sun gears. The two swing arms are respectively assembled to outer sides of the two sun gears and fixedly connected to the shaft. The two planet gears are respectively pivoted on the two swing arms. Each of the two planet gears is engaged, one to one, with the corresponding sun gear. Each of the cranks has a first end and a second end. The first end of each of the two cranks is coaxially connected to the corresponding planet gear via the corresponding swing arm, and the second end of each of the two cranks is pivoted with a pedal.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIG. 1 to FIG. 7, illustrating exemplary embodiments according to the present invention. The embodiments are provided for illustrative purposes, and the claimed scope of the present invention is not limited thereto.

Figure 1:
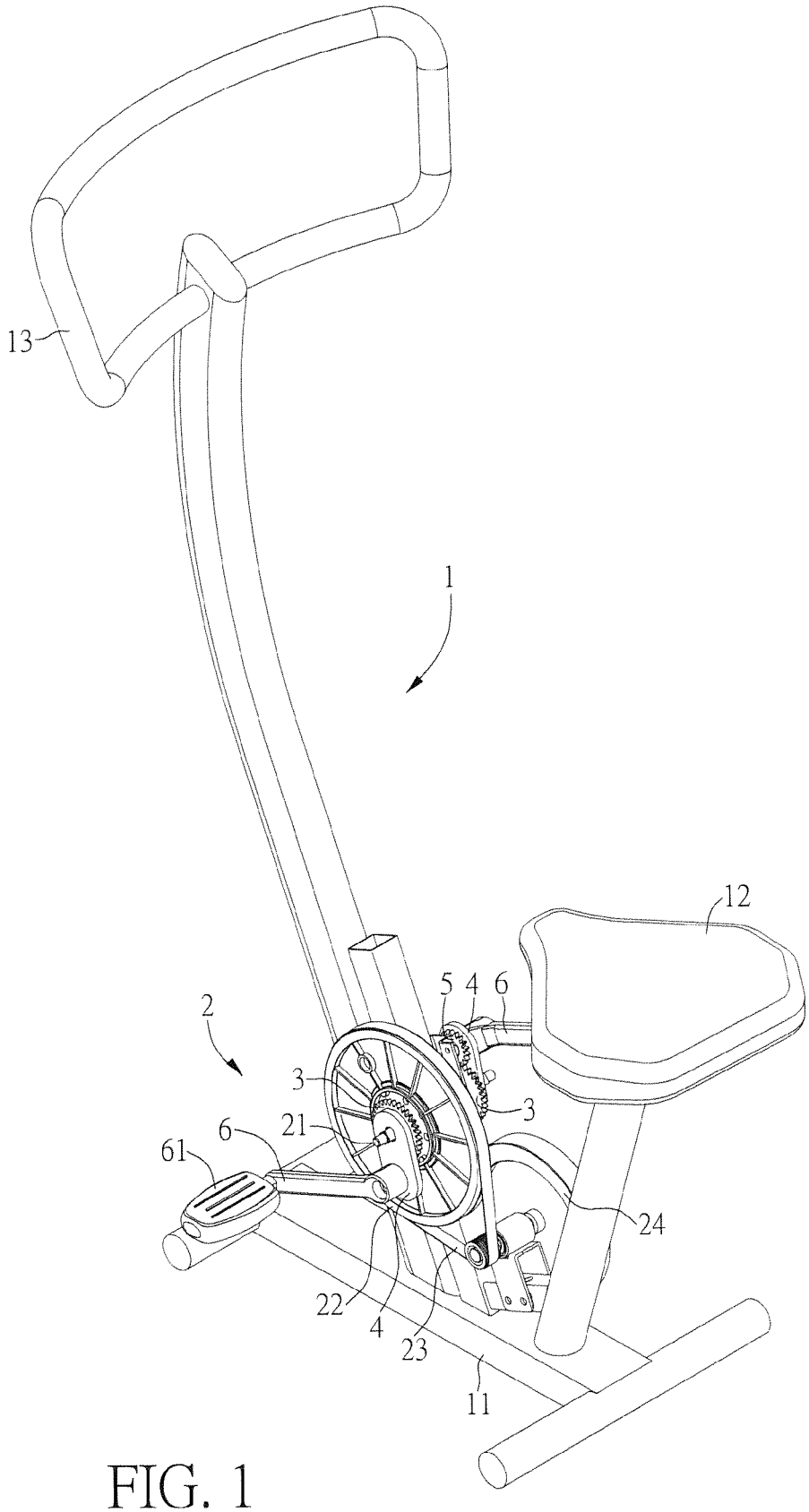
FIG. 1 illustrates a perspective view of a first embodiment of an exercise bike according to the present invention.

A first embodiment according to the present invention provides an exercise bike, as shown in FIG. 1. The exercise bike comprises a frame 1, a driving member 2, two sun gears 3, two swing arms 4, two planet gears 5, and two cranks 6. As shown in FIG. 1, a base 11 is assembled to the frame 1. A seat 12 and a handlebar 13 are assembled on the base 11, and the handlebar 13 is in front of the seat 12.

Figure 2:
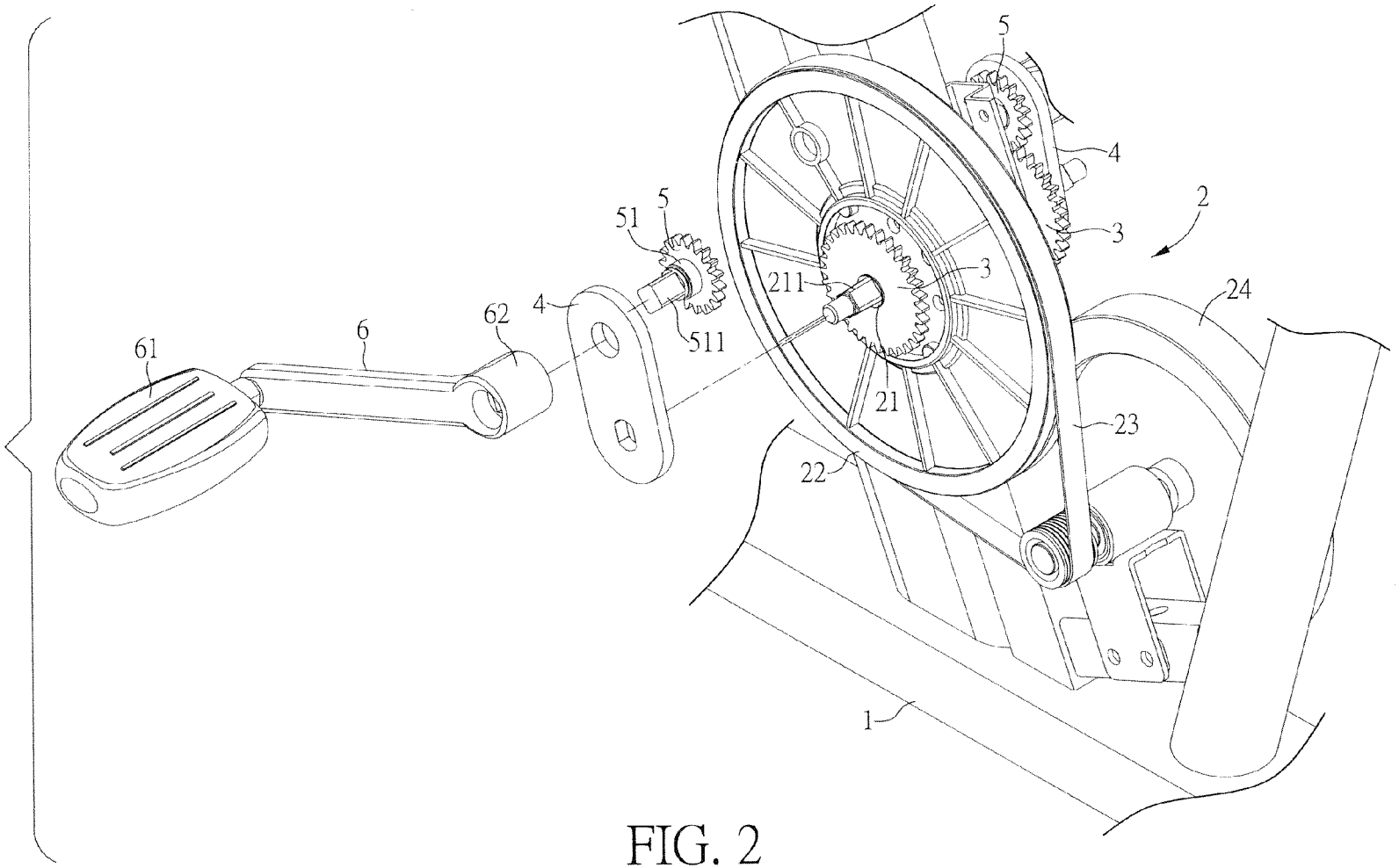
FIG. 2 is a partial enlarged view illustrating a driving member, sun gears, swing arms, planet gears, and cranks are assembled to a frame of the exercise bike according to the present invention.

As shown in FIG. 2, the driving member 2 is assembled to the frame 1. The driving member 2 has a shaft 21 being rotatable. The shaft 21 is extending from two sides of the frame 1. In this embodiment, the driving member 2 comprises a flywheel 22 connected to a passive wheel 24 via a belt 23, and the flywheel 22 is rotated under loading of the passive wheel 24.

As shown in FIG. 2, the two sun gears 3 are respectively coaxially fitted over the shaft 31 to be fixed as two sides of the driving member 2, and two ends of the shaft 21 are respectively passing through the two sun gears 3. In this embodiment, the two sun gears 3 are respectively fixed to two sides of the flywheel 22, and the flywheel 22 and the two sun gears 3 are coaxially arranged.

Figure 3:
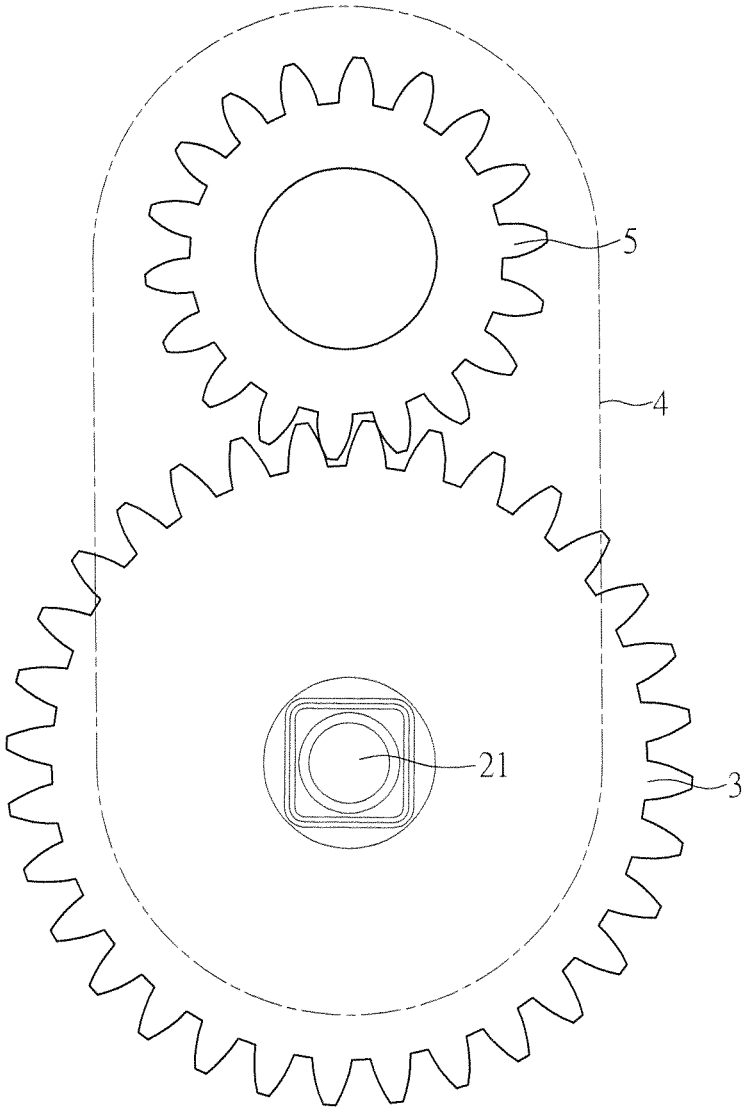
FIG. 3 is a schematic view illustrating one sun gear is engaged with one planet gear at the same side of the swing arm.

As shown in FIG. 2, the two swing arms 4 are respectively assembled to outer sides of the two sun gears 3 and fixedly connected to the shaft 21. The two planet gears 5 are respectively pivoted on the two swing arms 4. As shown in FIG. 3, each of the planet gears 5 is engaged, one to one, with the corresponding sun gear 3. Each of the cranks 6 has a first end and a second end. The first end of each of the cranks 6 is coaxially connected to the corresponding planet gear 5 via the corresponding swing arm 4, and the second end of each of the cranks 6 is pivoted with a pedal 61.

As shown in FIG. 2, in this embodiment, each of the planet gears 5 has a spindle 51 coaxially extending therefrom and passing through the corresponding swing arm 4. A first mating end 211 is formed at each of the two ends of the shaft 21. A second mating end 511 is formed at an end portion of each of the spindles 51. The first end of each of the cranks 6 has a mating portion 62 selectively fitted over the corresponding first mating end 211 of the shaft 21 or the second mating end 511 of the corresponding spindle 51.

Figure 4:
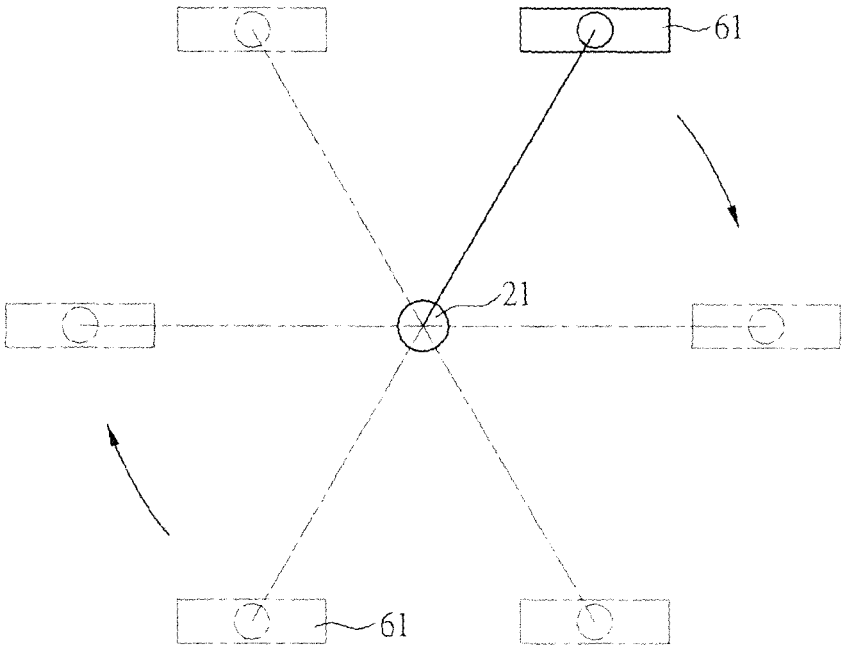
FIG. 4 is a schematic view illustrating one pedal of the exercise bike is rotated around the shaft, according to the first embodiment of the present invention.

If the mating portions 62 of the cranks 6 are respectively fitted over the first mating ends 211 of the shaft 21, the two pedals 61 will be moved around the shaft 21 using the shaft 21 as the rotating axis when a user treads on the pedals 61, as shown in FIG. 4. Accordingly, the trace of the pedals 61 is similar to that of the conventional.

Figure 5:
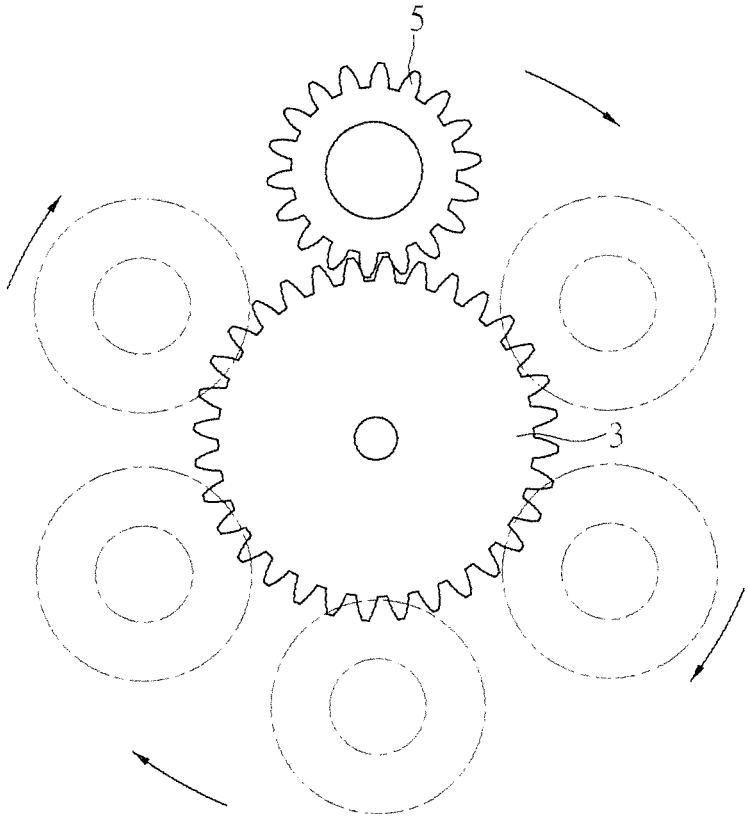
FIG. 5 is a schematic view illustrating one planet gear is rotated around one sun gear.
Figure 6:
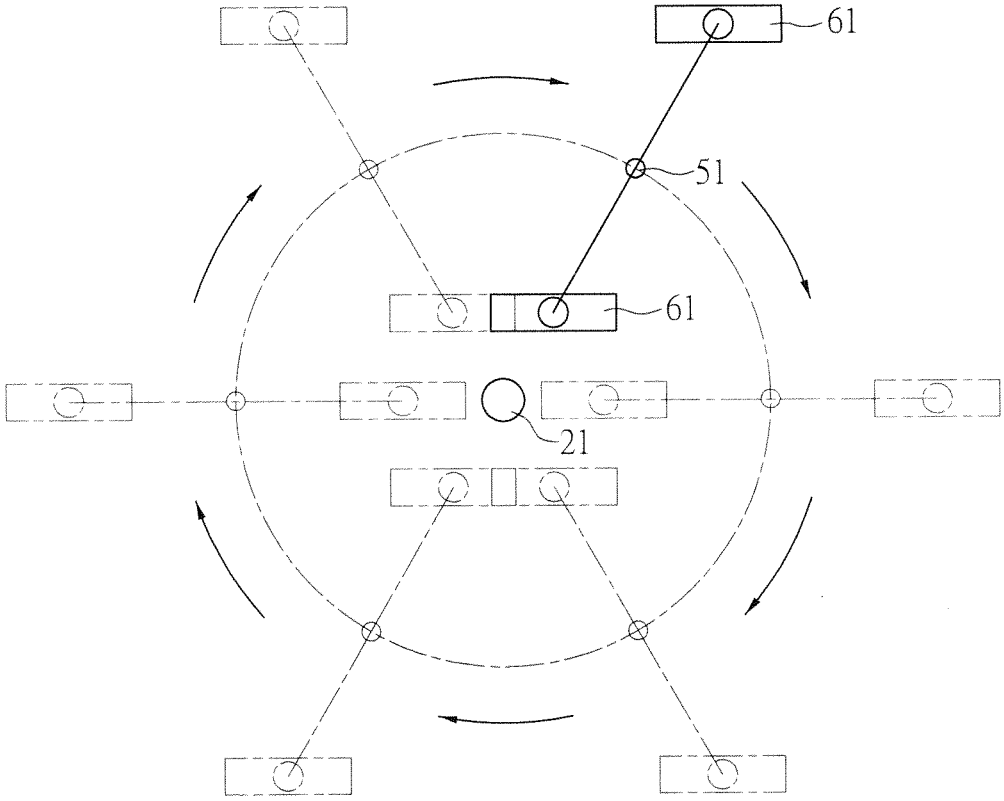
FIG. 6 is a schematic view illustrating a spindle of one planet gear is rotated around the shaft, according to the first embodiment of the present invention.

If the mating portions 62 of the cranks 6 are respectively fitted over the second mating ends 511 of the spindles 51, each of the two pedals 62 will be moved around the corresponding spindle 51 using the corresponding spindle 51 as the rotating axis when a user treads on the pedals 61, and the cranks 61 will further drive the planet gears 5 to rotate, such that each of the planet gears 51 will move around the corresponding sun gear 3, as shown in FIG. 5. There fore, as shown in FIG. 6, the spindle 51 of each of the planet gears 5 is moved around the shaft 21 using the shaft 21 as the rotating axis. Accordingly, when the user treads on the pedals 61 to allow each of the pedals 61 to move around the corresponding spindle 51, each of the spindles 51 is moved around the shaft 21 using the shaft 21 as the rotating axis. Therefore, the pedals 61 are not simply moved around the same rotating axis. Consequently, compared with the conventional exercise bike, the exercise bike according to the present invention allows the user to use more muscle groups during the exercise. Furthermore, the exercise bike according to the present invention presents different feelings during the exercise, facilitating the user to use the exercise bike more frequently.

Figure 7:
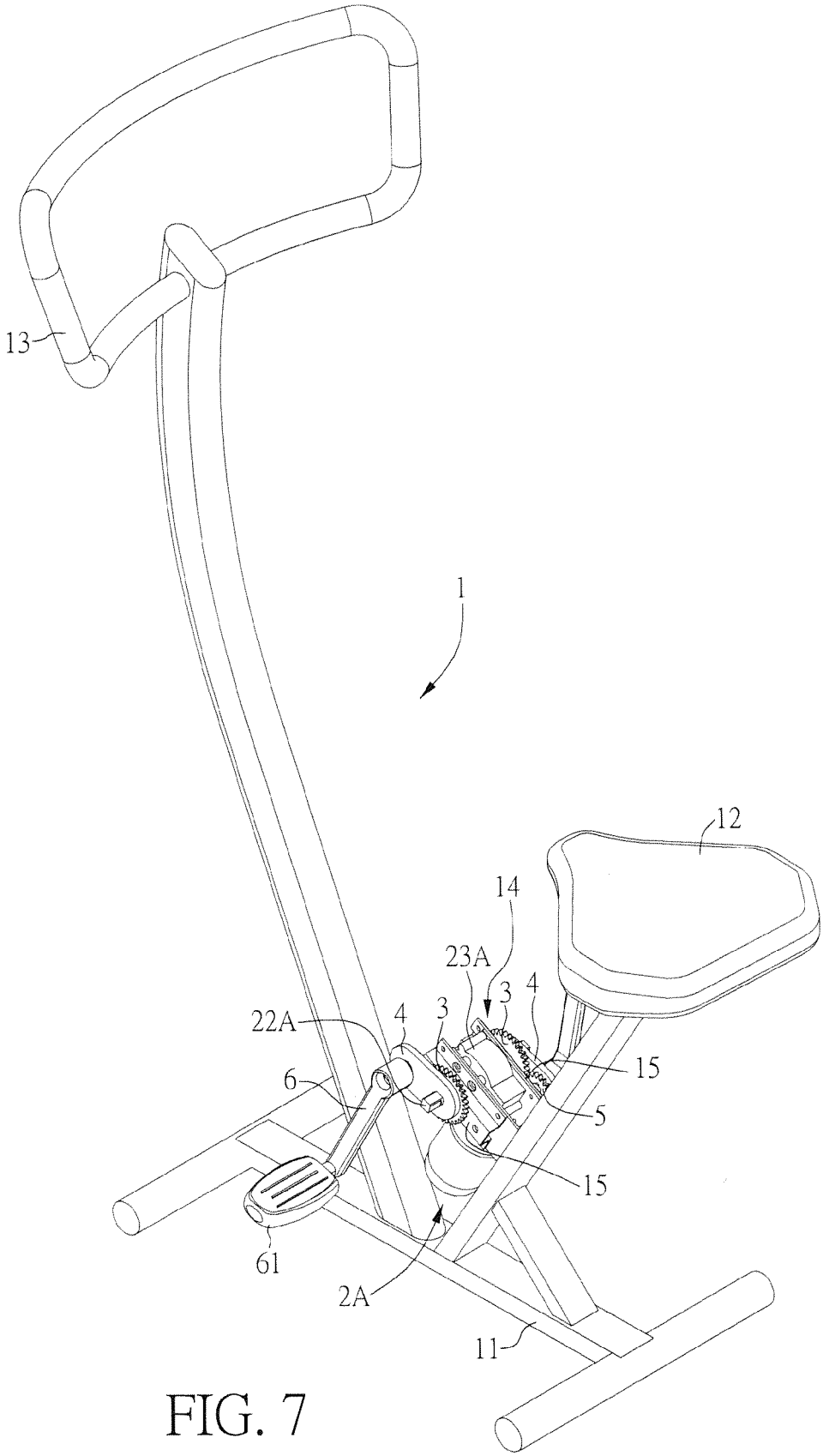
FIG. 7 illustrates a perspective view of a second embodiment of an exercise bike according to the present invention.
Figure 8:
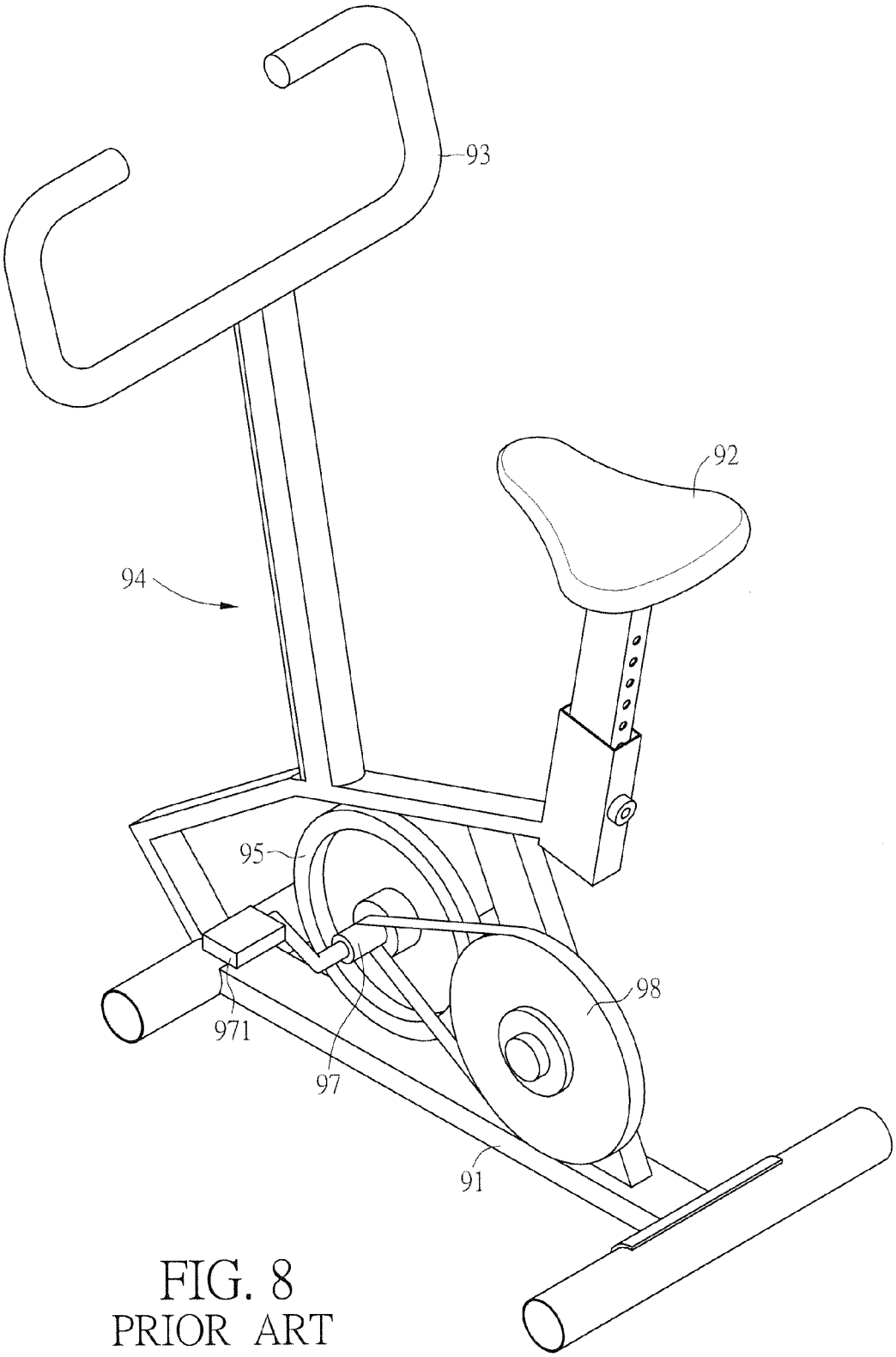
FIG. 8 PRIOR ART
FIG. 8 illustrates a perspective view of a conventional exercise bike.

It is understood that the present invention may include several variations or modifications. Please refer to FIG. 7, illustrating a second embodiment of an exercise bike according to the present invention. The second embodiment is approximately similar to the first embodiment, except that in the second embodiment, the driving member 2A comprises a driving motor 22A and a speed reducer 23A, and the shaft 21A is extending from two sides of the speed reducer 23A. A fixing bracket 14 is assembled to the frame 1, and the driving member 2A is fixed in the fixing bracket 14. Two fixing plates 15 are respectively fixed to two sides of the fixing bracket 14, and the two sun gears 3 are respectively fixed to the two fixing plates 15.

In this embodiment, the shaft 21A is driven by the driving motor 22A of the driving member 2A and the rotational speed is reduced by the speed reducer 23A. If the mating portions 62 of the cranks 6 are respectively fitted over the second mating ends 511 of the spindles 51, the shaft 21A will drive the swing arms 4 to rotate circularly, such that each of the planet gears 5 is rotated around the corresponding sun gear 3, and the two cranks 6 are respectively rotated around the shaft 21A along with the rotation of the planet gears 5. Accordingly, when the user put his/her legs on the pedals 61, the exercise bike allows the user to move his/her legs passively along with the movement of the cranks 61 as like the user treads on the pedals 61 by himself/herself. Besides, the way how the cranks 61 move in this situation is substantially the same as the way how the cranks 61 move when a user treads on, thus allowing a user to do rehabilitation.

In addition, in the situation that the driving motor 22A is turned off, the shaft 21A would start rotating when the force applied to the pedals 61 overcomes the resistance provided from the speed reducer 23A. Under this condition, the speed reducer 23A can be regarded as the passive wheel 24 described in the first embodiment, and the user can tread on the pedals 61 for exercise. Accordingly, the driving member 2A of the second embodiment may act the same function as that of the first embodiment.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. An exercise bike, comprising:

a frame, assembled to a base, wherein a seat and a handlebar are assembled on the base, the handlebar is in front of the seat;

a driving member assembled to the frame and has a shaft being rotatable, wherein the shaft is extending from two sides of the frame;

two sun gears, respectively coaxially fitted over the shaft to be fixed at two sides of the driving member, two ends of the shaft respectively passing through the two sun gears;

two swing arms, respectively assembled to outer sides of the two sun gears and fixedly connected to the shaft;

two planet gears, respectively pivoted on the two swing arms, each of the two planet gears is engaged, one to one, with the corresponding sun gear; and two cranks, each having a first end and a second end, wherein the first end of each of the two cranks is coaxially connected to the corresponding planet gear via the corresponding swing arm, and the second end of each of the two cranks is pivoted with a pedal.

2. The exercise bike according to claim 1, wherein the driving member comprises a flywheel connected to a passive wheel via a belt, the flywheel is rotated under loading of the passive wheel, the two sun gears are respectively fixed to two sides of the flywheel, the flywheel and the two sun gears are coaxially arranged.

3. The exercise bike according to claim 1, wherein the driving member comprises a driving motor and a speed reducer, the shaft is extending from two sides of the speed reducer.

4. The exercise bike according to claim 3, wherein a fixing bracket is assembled to the frame, the driving member is fixed in the fixing bracket, two fixing plates are respectively fixed to two sides of the fixing bracket, and the two sun gears are respectively fixed to the two fixing plates.

5. The exercise bike according to claim 1, wherein each of the planet gears has a spindle coaxially extending therefrom and passing through the corresponding swing arm, a first mating end is formed at each of the two ends of the shaft, a second mating end is formed at an end portion of each of the spindles, the first end of each of the cranks has a mating portion selectively fitted over the corresponding first mating end of the shaft or the second mating end of the corresponding spindle.

* * * * *